US006098197A

United States Patent [19]

Hetzel, Jr. et al.

[11] Patent Number: 6,098,197

[45] Date of Patent: Aug. 8, 2000

[54] LEATHER FIREFIGHTER HELMET AND METHOD FOR MAKING A LEATHER FIREFIGHTING HELMET

[75] Inventors: John M. Hetzel, Jr., Centerville; Abbott A. Lane, Dayton, both of Ohio

[73] Assignee: Firequip Helmets, Inc., Dayton, Ohio

[21] Appl. No.: 09/243,250

[22] Filed: Feb. 3, 1999

Related U.S. Application Data

[60] Provisional application No. 60/090,884, Jun. 26, 1998.

[51] Int. Cl.[7] ..... A42B 3/00

[52] U.S. Cl. ..... 2/5; 2/175.1; 2/200.1; 2/410; 2/411; 223/7; 223/26

[58] Field of Search ..... 2/5, 175.1, 175.4, 2/175.5, 410, 412, 200.1, 411; 223/7, 12, 24, 26

[56] References Cited

U.S. PATENT DOCUMENTS 4,035,845 7/1977 Hochwalt ..... 2/6.2

5,590,820 1/1997 Plastino ..... 223/12

OTHER PUBLICATIONS

Advertisement from Cairns & Brother.

*Primary Examiner*—Diana Oleksa

*Attorney, Agent, or Firm*—Thompson Hine & Flory LLP

[57] ABSTRACT

A method for fabricating the leather firefighting helmet includes the steps of: (a) providing an outer leather covering, where the covering includes a bowl-shaped head portion attached to a brim portion; (b) providing an inner leather liner, where the liner includes a bowl-shaped head portion attached to a brim portion; (c) positioning a layer of reinforcing fibers between the covering and the inner liner; (d) positioning liquid thermoset resin between the covering and the liner; (e) assembling the cover with the liner such that the bowl-shaped head portion of the liner is received within the bowl-shaped head portion of the covering; and (f) curing the covering, liner, reinforcing fibers and thermoset resin together to form a substantially unitary firefighting helmet.

35 Claims, 7 Drawing Sheets

LEATHER FIREFIGHTER HELMET AND METHOD FOR MAKING A LEATHER FIREFIGHTING HELMET

CROSS REFERENCE TO RELATED APPLICATIONS

The present invention claims priority under 35 U.S.C. §119 from Provisional Application Ser. No. 60/090,884, filed Jun. 26, 1998.

BACKGROUND

The present invention relates to protective head gear and, more particularly, to leather firefighter helmets and methods for making such leather firefighting helments.

The popularity of leather firefighting helmets has seen a substantial increase in recent years. Despite this increase in popularity, only a small percentage of firefighting companies use leather helmets due to the relatively high cost and low durability of the leather helmets.

There are several known versions of leather firefighting helmets commercially available. Such leather helmets include an outer leather covering attached to an inner liner made from a solid or polycarbonate resin material. A disadvantage with leather helmets constructed in such a way is that the leather coverings have portions which are loosely attached or glued to the inner solid liners. Over extensive use of the helmet and the extreme conditions in which the firefighters typically find themselves, because the leather helmets are constructed in such a way, the outer leather coverings of the helmets typically begin to shrink and crack.

Another disadvantage with conventional leather firefighting helmets is that they are typically constructed from vegetable tanned leather, which is easy to work with. However, the vegetable tanned leather does not have high heat resistance.

Accordingly, there is a need for a leather firefighting helmet which has an outer leather liner which resists shrinkage and cracking and which also has a relatively high heat resistance; and accordingly has longer life.

SUMMARY

The present invention provides a composite leather firefighting helmet and a method for constructing the composite leather firefighting helmet, where the composite leather firefighting helmet includes a leather outer covering and a (preferably leather) inner liner bonded together by curing a thermoset resin, such as an epoxy based vinyl ester, with reinforcing fibers therebetween. The process provides an essentially unitary construction where the outer leather covering is not able to shift, flex or deform with respect to the inner liner. Therefore, the outer leather covering will be much less susceptible to shrinking and cracking as compared to the prior art leather helmets.

A method for fabricating the leather firefighting helmet according to one aspect of the present invention comprises the steps of: (a) providing an outer leather covering, where the covering includes a bowl-shaped head portion attached to a brim portion; (b) providing an inner leather liner, where the liner includes at least a bowl-shaped head portion; (c) positioning a layer of reinforcing fibers between the covering and the inner liner; (d) positioning thermoset resin between the covering and the liner; (e) assembling the cover with the liner such that the bowl-shaped head portion of the liner is received within the bowl-shaped head portion of the covering; and (f) curing the covering, liner, reinforcing fibers and thermoset resin together to form a substantially unitary firefighting helmet.

Preferably the curing step includes the step of pressing the covering and liner together, applying an appropriate temperature and pressure, for a sufficient period of time so that the resin liquefies, if not already liquid, then flows around the reinforcing fibers and bonds the covering, the inner liner and reinforcing fibers together. The appropriate temperature applied ranges from approximately 100° F. to approximately 200° F. (the actual curing temperature within the resin will be much higher), the appropriate pressure applied ranges from approximately 300 psi to approximately 500 psi, and the sufficient period of time ranges from approximately 10 minutes to approximately 25 minutes.

According to another aspect of the present invention, a method for fabricating a firefighting helmet comprises the steps of: (a) providing an inner liner, where the inner liner includes a bowl-shaped head portion attached to a brim portion; (b) partially curing a composite layer of thermoset resin and reinforcing fibers to an outer surface of the inner liner; (c) providing an outer leather covering, where the covering includes a bowl-shaped portion attached to a brim portion; (d) assembling the covering with the liner such that the bowl-shaped head portion of the liner is received within the bowl-shaped head portion of the covering; and (e) finally curing the covering, liner, reinforcing fibers and resin together to form a substantially unitary firefighting helmet component. Preferably, prior to the final curing step, the method also includes the step of applying a relatively thin 'hot coat' layer of thermoset resin to the inner surface of the covering.

It has been found that by partially curing the composite layer of thermoset resin and reinforcing fibers to the inner liner before finally-curing the cover and inner liner together, the thermoset resin will be much less likely to flow through the stitched seams in the outer covering during the final curing step. This substantially eliminates the need to 'clean' hardened thermoset resin from the outer, finished surfaces of the firefighting helmet when the curing processes are complete.

In yet another aspect of the present invention, a method for fabricating a firefighting helmet comprises the steps of: (a) providing a male mold component, where the male includes a flat active surface in a substantially hemispherical lobe extending therefrom; (b) providing a female mold component, where the female mold component has a flat active surface and a substantially hemispherical cavity extending into the flat active surface; (c) orienting the male and female mold components so that the hemispheric lobe of the male mold component is received within the hemispherical cavity of the female mold component when they are pressed towards one another; (d) providing an outer leather covering, the covering including a bowl-shaped head portion attached to a brim portion; (e) positioning the outer covering on the female mold component, where the bowl-shaped head portion is received within the hemispherical cavity of the female mold component and the brim portion is received on the flat active surface of the female mold component; (f) providing an inner liner, where the inner liner includes a bowl-shaped head portion attached to a brim portion; (g) positioning the inner liner on the male mold component, where the bowl-shaped head portion is received on the hemispherical lobe of the male mold component and the brim portion is received on the flat active surface of the male mold component; (h) positioning a layer of reinforcing fibers between the covering and the inner liner; (i) positioning thermoset resin between the covering and the inner liner;

and (j) finally-curing the inner liner, the reinforcing fibers, the thermoset resin and the outer covering together by pressing the male and female mold components together for a final-curing time.

Preferably, the step of positing thermoset resin between the covering and the inner liner includes the steps of: (a) providing a layer of thermoset resin-repellant material on the flat active surface and cavity surface of the female mold component; (b) positioning the inner liner on the male mold component; (c) positioning the layer of reinforcing fibers and the thermoset resin between the inner liner and the layer of epoxy repellant material; and (d) partially-curing the thermoset resin and the reinforcing fibers to the inner liner by pressing the male and female mold components together for a partial-curing time. Furthermore, the step of providing a layer of thermoset resin repellant material on the flat inner surface and cavity of the female mold component includes the steps of: (i) providing a dummy covering of flexible material, where the dummy covering includes a bowl-shaped head portion and a brim portion extending therefrom; (ii) applying a layer of thermoset resin repellant material to an inner surface of the dummy covering; and (iii) positioning the dummy covering on the female mold component, where the bowl-shaped head portion is received within the hemispherical cavity of the female mold component and where the brim portion is received on the flat active surface of the female mold component. Preferably, the layer of thermoset resin-repellant material is a sheet of natural rubber material; the partial-curing time is approximately 6 to approximately 9 minutes and the final-curing time is at least approximately 3 minutes. Finally, the method further preferably comprises the step of, after the final curing step, placing the finally cured helmet in a post-curing temperature for a post-curing time, where the post-curing temperature applied ranges from approximately 100° to approximately 200° F. and where the post-curing time ranges from approximately 2 hours to approximately 12 hours.

In yet another aspect of the present invention, a method for fabricating a leather helmet according to one aspect of the present invention comprises the steps of: (a) providing an outer leather covering, where the covering includes at least a bowl-shaped head portion; (b) providing an inner leather liner, where the liner includes at least a bowl-shaped head portion; (c) positioning a layer of reinforcing fibers between the covering and the inner liner; (d) positioning thermoset resin between the covering and the liner; (e) assembling the cover with the liner such that the bowl-shaped head portion of the liner is received within the bowl-shaped head portion of the covering; and (f) curing the covering, liner, reinforcing fibers and thermoset resin together to form a substantially unitary and rigid helmet.

Accordingly, it is an object of the present invention to provide a leather firefighting helmet and a method for constructing such a leather firefighting helmet. It is also an object of the present invention to provide a leather firefighting helmet which has an outer leather covering that resists shrinkage and cracking and also has a relatively high heat resistance. These and other objects and advantages of the present invention will be apparent from the following description, the appended claims and the attached drawings.

DETAILED DESCRIPTION

The present invention provides a composite leather firefighting helmet and a method for constructing the composite leather firefighting helmet, where the composite leather firefighting helmet includes a leather outer covering and a (preferably leather) inner liner bonded together by curing a thermoset resin, such as an epoxy based vinyl ester, with reinforcing fibers therebetween. The process provides an essentially unitary construction where the outer leather covering is not able to shift, flex or deform with respect to the inner liner. Therefore, the outer leather covering will be much less susceptible to shrinking and cracking as compared to pior art leather helmets.

Figure 1:
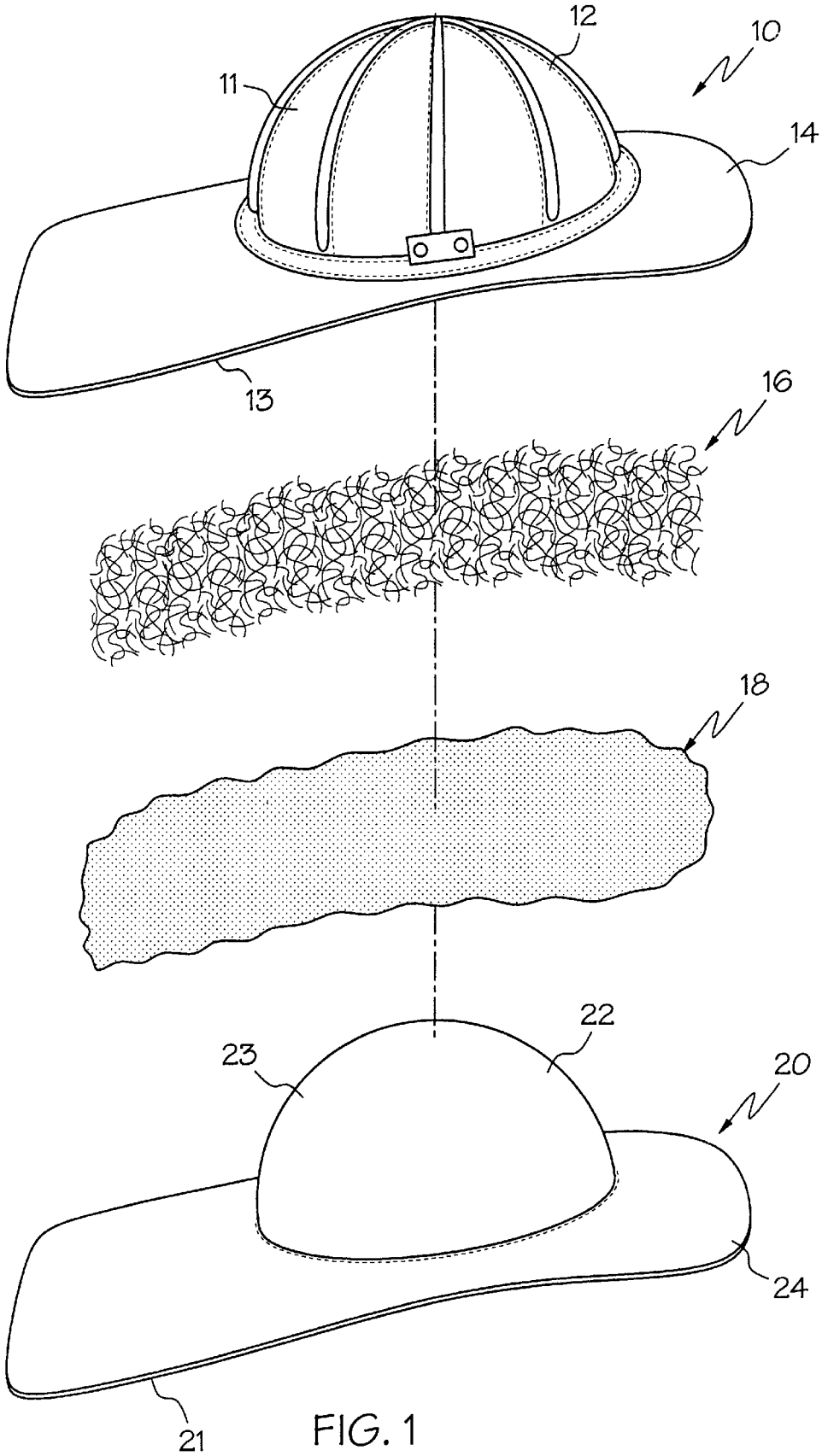
FIG. 1 is a perspective, exploded view of the individual components making up the leather firefighting helmet of the present invention.

As shown in FIG. 1, an embodiment of the present invention provides a protective head gear, and more particularly a composite leather firefighting helmet, which is constructed according to the following steps. An outer leather covering 10, having a bowl shaped head portion 12 stitched, or otherwise attached to a brim portion 14 is provided, where the leather of the outer cover 10 has a finished outer surface 11 and a rough inner surface 13. The rough inner surfaces of the outer covering 10 are coated with reinforcing fibers 16 such as glass, aramid and/or azol fibers, and the rough inner surfaces of the outer liner 10 and fibers 16 are also coated with a liquid thermoset resin 18, such as a vinyl ester, polyester or epoxy resin. An inner liner 20, preferably of leather material, having a bowl shaped head portion 22 and a brim portion 20 stitched to, or otherwise attached to the head portion 22 is also provided; where the leather of the inner liner 20 has a finished inner surface 21 and a rough outer surface 23. The inner liner 20 is received within the outer covering 10 over the fibers 16 and liquid resin material 18. Finally, the above helmet components are placed within a mold, which is preferably shaped as a negative impression of the finished helmet (see FIG. 2 and the corresponding description below), and pressed together at a relatively high temperature for a sufficient period of time such that the resin material cures, thereby forming mechanical bonds between the adjacent rough surfaces of the outer covering and inner liner to create an essentially unitary component.

As used herein the term 'thermoset resin' is intended to include the ploymeric materials and curing agents necessary to cross link the resin into a thermoset. Choice of a curing agent will depend on the particular thermoset resin employed. Typical thermoset resins which can be used include epoxies, vinylized epoxies, vinyl esters and polyesters. The preferred thermoset resin is an epoxy based vinyl ester (commercially available from Ashland Chemical Co.)

used in conjunction with a catalyst such as methyl ethyl ketone (MEK). It will be apparent to those of ordinary skill in the art that other suitable catalysts are available for the same purpose, and are therefore within the scope of the present invention. Additionally, while a liquid thermoset resin is preferred, it is within the scope of the present invention to use other forms or phases of the thermoset resin material.

Furthermore, while it is preferred that the reinforcing fibers 16 are glass, aramid and/or azol fibers, it is within the scope of the invention that any type of fiber providing structure, strength and heat resistance for the firefighting helmet will fall within the scope of the invention.

It should be apparent that all of the above steps need not be performed in the exact order as indicated. For example, the thermoset resin 18 may be applied before, or at the same time as the fibers 16.

In one embodiment of the present invention, the components are placed within the mold for approximately 15 to 20 minutes, applying a temperature of approximately 120° F. and a pressure of approximately 300 psi to 500 psi so that a curing temperature of approximately 300° F. is produced. When the helmet is being cured, the resin (liquefies if necessary and then) flows throughout the rough inner surfaces 13 of the outer covering 10 and the rough outer surfaces 23 of the inner liner 20, and all around the fibers 16 thereby causing the components 10, 20 to essentially become unitary with the fibers 16 and to each other.

Because the process of the present invention provides a helmet where the outer leather covering 10 is essentially unitary with respect to the inner liner 20 and reinforcing fibers 16, the outer leather covering will not shift, flex or deform with respect to the inner liner. Thus, the outer leather covering will be much less susceptible to shrinking and cracking as compared to the prior art leather helmets.

The outer covering 10 is preferably 0.080" thick, chrome tanned leather and the inner liner is preferably 0.050" thick, chrome tanned leather. Because chrome tanned leather is preferred over vegetable tanned leather, the helmet resulting from the process of the present invention will have substantially higher heat resistance and will be less susceptible to shrinkage than the prior art leather helmets. It is to be understood, however, that it is within the scope of the invention to use vegetable tanned leather, as well as other types of leather; and it is also within the scope of the present invention to use alternate thicknesses of leather. To save cost, the leather inner liner may also be replaced by a less expensive non-leather inner liner. Such suitable non-leather materials may include, for example, woven aramid fabric materials or any other suitable non-leather inner liner materials, all of which fall within the scope of the present invention. Furthermore, while firefighting helmets, and other forms of protective head gear utilize brims, it is within the scope of the invention that the outer covering and/or the inner liner not include a brim portion.

Figure 2:
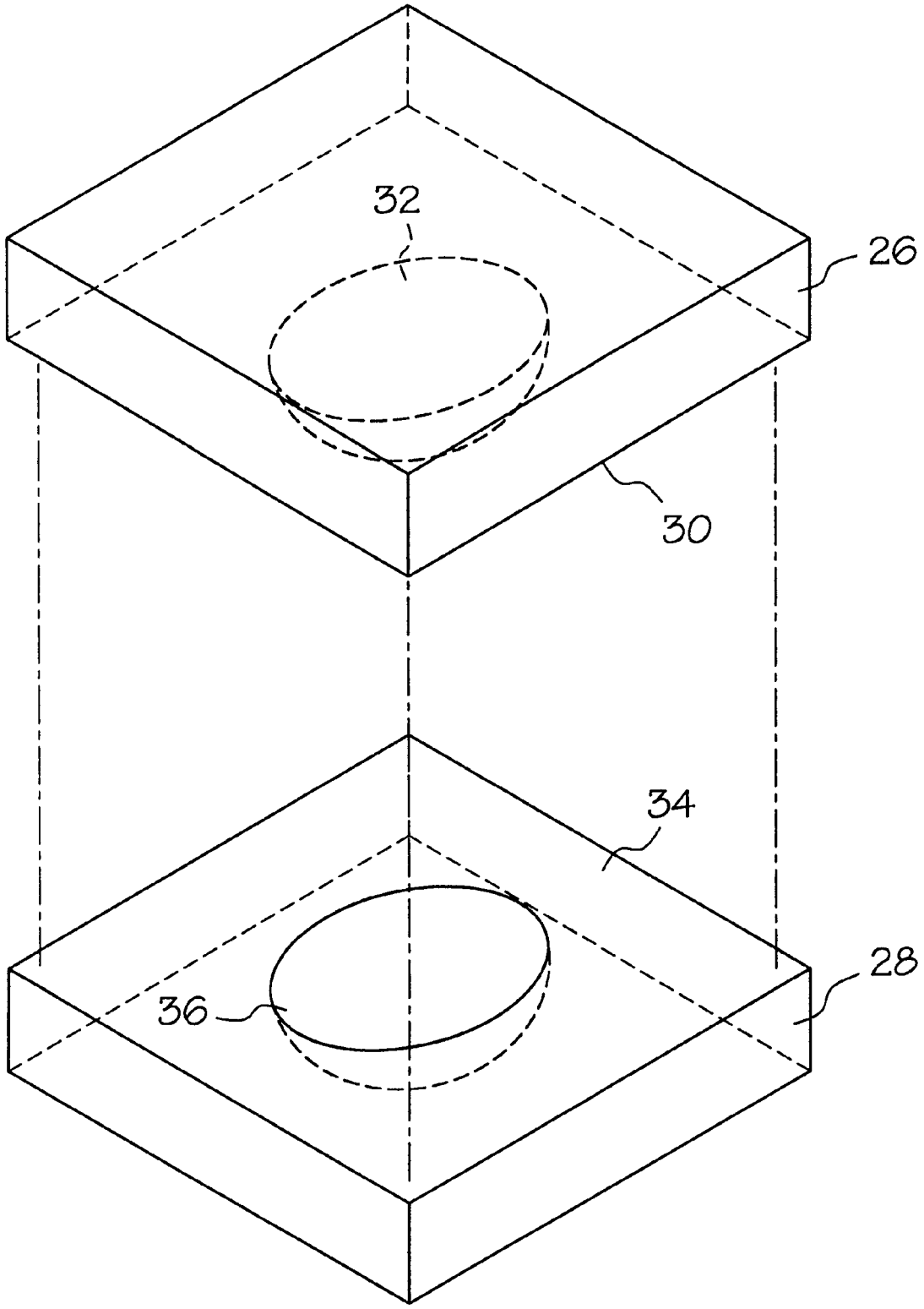
FIG. 2 is a schematic, perspective view of a mold for use with the process of the present invention.

As shown in FIG. 2, a mold device for use with the present invention includes a male mold component 26, a female mold component 28 and associated mechanical components (not shown) for driving the mold components towards and away from one another, and also for heating the mold components if desired. The male mold component has a flat active surface 30 and a substantially hemispherical lobe 32 extending from the flat active surface 30. The female mold component has a flat active surface 34 and a substantially hemispherical recess 36 extending into the flat active surface. The male and female mold components 26, 28 are oriented such that the hemispherical lobe 32 of the male mold component 26 is received within the hemispherical recess 36 of the female mold component 28 when the mold mechanism is activated to press the male mold component and the female mold components towards one another. Such mold devices are conventional and commercially available to those of ordinary skill in the art; therefore, additional disclosure with respect to the design and operation of the mold device is not necessary.

Figure 3:
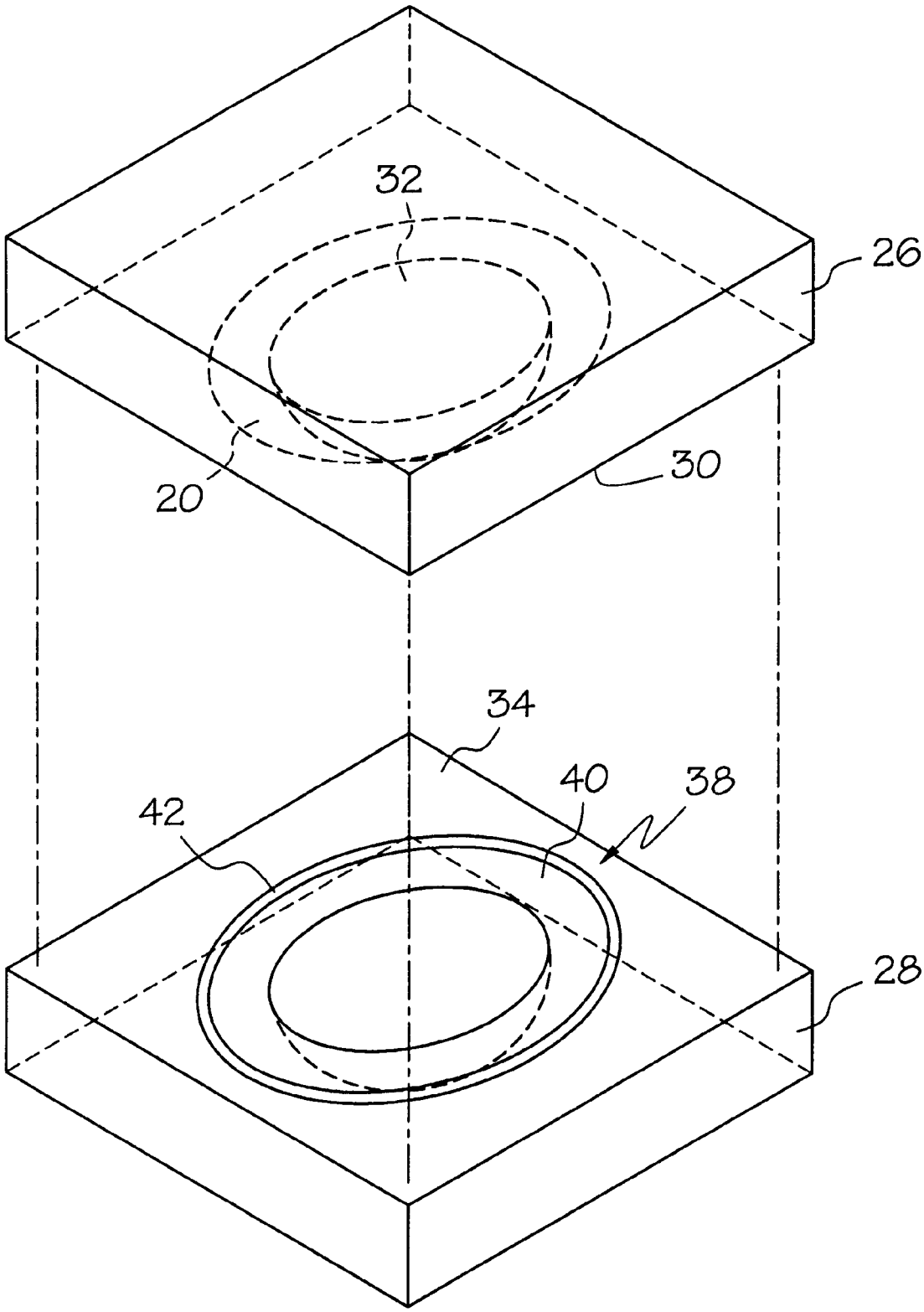
FIG. 3 illustrates a process step of the preferred embodiment of the present invention utilizing the mold component.

FIGS. 3–8 are used to illustrate a preferred embodiment of a procedure for fabricating the leather firefighting helmet of the present invention. As shown in FIG. 3, an initial step is to place the inner liner member 20 onto the male mold component such that the rough outer surface 23 of the inner liner member faces the female mold component, such that the bowl-shaped head portion 22 of the inner liner member is received on the hemispherical lobe 32 of the male mold component and such that the brim portion 24 of the inner liner member is received on the flat active surface 30 of the male mold component. Also, a 'dummy' covering member 38 is placed on the female mold component 28. In the present embodiment, the 'dummy' covering member 38 is merely a covering member 10 where the rough inner surface 14 is lined with an thermoset resin-repellant material, such as a natural rubber lining 40. A thermoset resin repellant material is a material or coating that will not mechanically or chemically bond to the thermoset resin composition during the partial curing step described above. Natural rubber is the preferred material chosen to line the 'dummy' member due to its ability to stretch and due to its durability. This natural rubber lining also preferably includes a built-up portion 42 around the periphery of the brim of the 'dummy' covering member 38 so as to provide a gasket, the function of which will be described below. The 'dummy' covering member 38 is placed on the female mold component such that the bowl shaped head portion of the 'dummy' covering member is received within the hemispherical recess 36 of the female mold component and such that the brim portion of the 'dummy' covering member is received on the flat active surface 34 of the female mold component.

Figure 4:
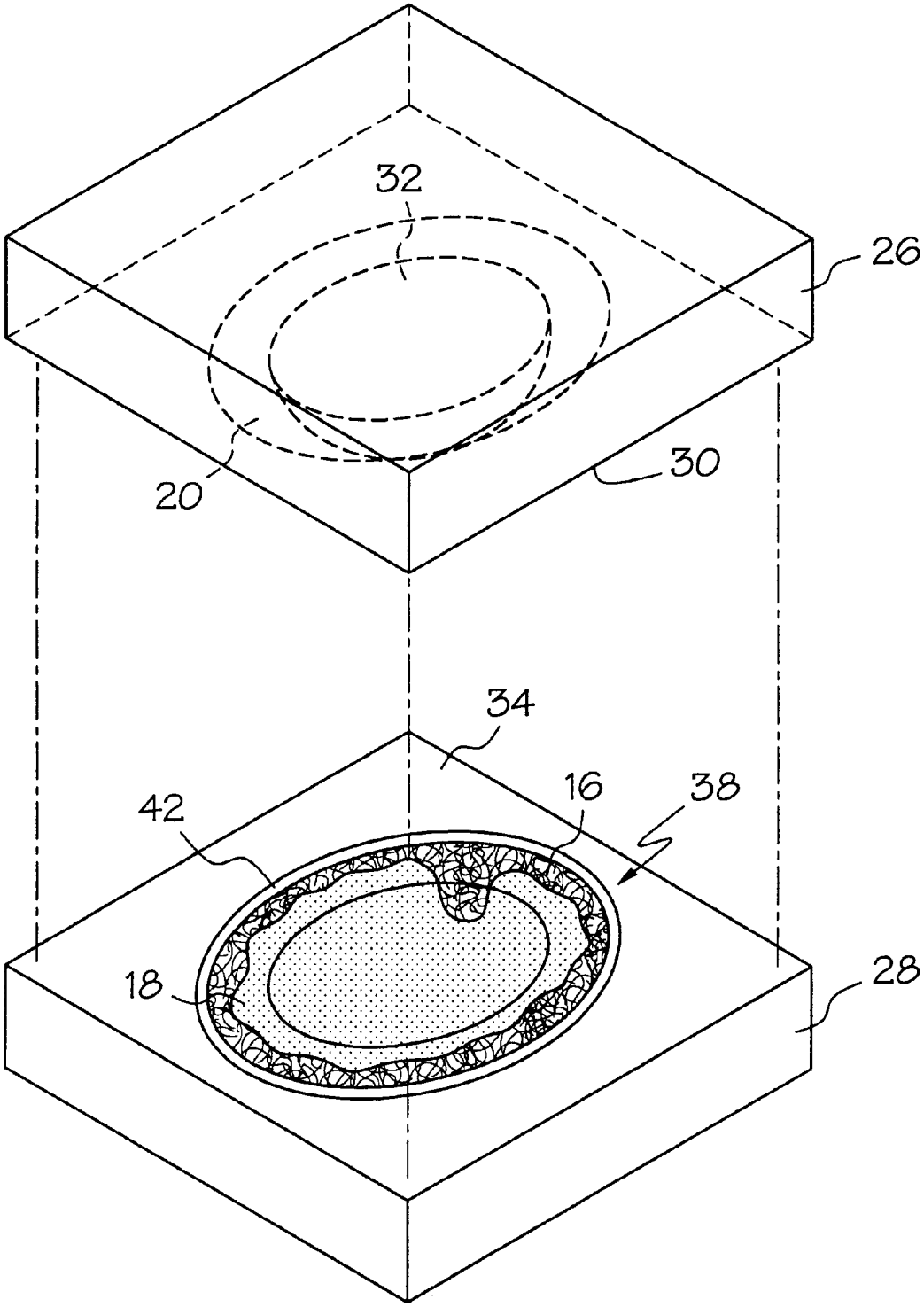
FIG. 4 illustrates another process step of the preferred embodiment of the present invention utilizing the mold component.

Next, as shown in FIG. 4, a layer of reinforcing fibers 16 is placed on the exposed surface of the 'dummy' member and the liquid thermoset resin solution 18 is then poured or otherwise spread onto the fibers 16. Preferably, the thermoset resin solution includes 380 g. of epoxy based vinyl ester and approximately 1% MEK (typically, one to three percent is preferred). Preferably, the layer of fibers 16 is a prefabricated, non-woven sheet of glass, aramid and/or azol fibers shaped to match the shape of the exposed surface of the 'dummy' member.

Figure 5:
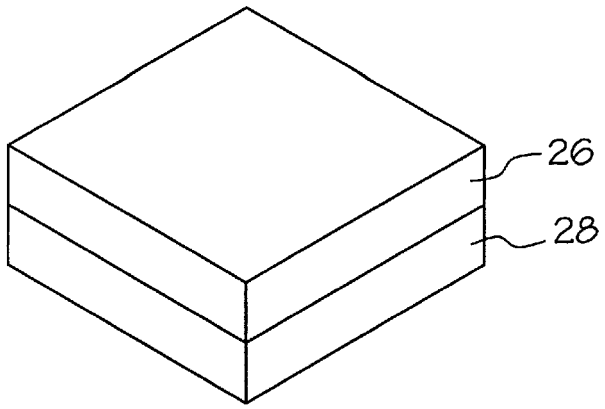
FIG. 5 illustrates another process step of the preferred embodiment of the present invention utilizing the mold component.

Next, as shown in FIG. 5, the mold device is activated such that the male mold component 26 and the female mold component 28 press against each other for a sufficient amount of time, applying a sufficient pressure and temperature, such that the thermoset resin begins to flow all around the fibers and begins to partially cure so as to form a substantially gelled thermoset resin and fiber composite. The gasket 42 on the dummy member 38 prevents the thermoset resin from flowing out from between the liner member and the dummy member. The partial curing time ranges from approximately 6 to approximately 9 minutes, the partial curing temperature applied to the mold components ranges from approximately 100° F. to approximately 200° F. (note that the curing temperature in the resin will be higher) and the partial curing pressure applied by the mold components ranges from approximately 300 psi to approximately 500 psi. Preferably, the partial curing time is approximately 7 minutes, the partial curing temperature applied to the mold components is 120° F. and the pressure applied by the mold components is 1000 psi.

Figure 6:
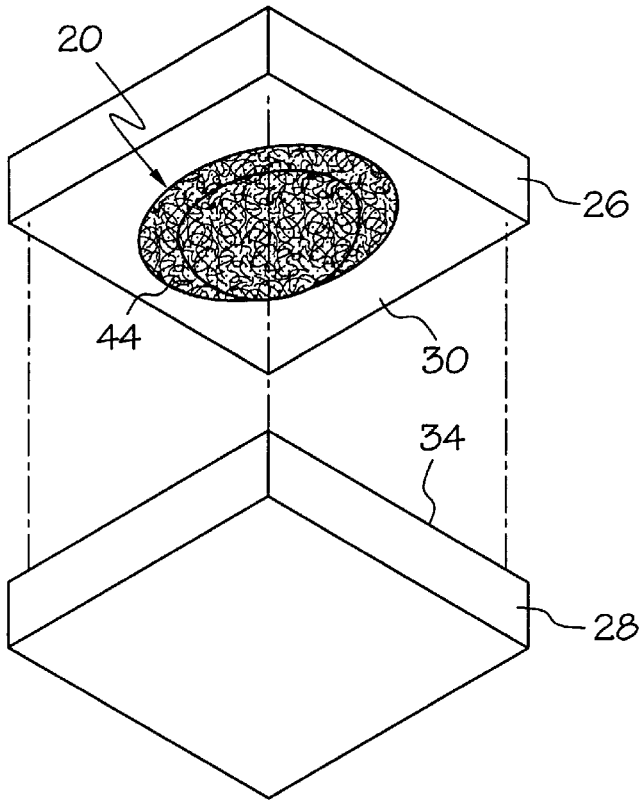
FIG. 6 illustrates another process step of the preferred embodiment of the present invention utilizing the mold component.

As shown in FIG. 6, when the thermoset resin composition is partially cured as described above, the male and female mold components 26, 28 are separated again, and because the natural rubber lining 40 of the dummy member 38 is a thermoset resin repellant material, the substantially gelled resin and fiber composition 44 is retained on the inner liner member 20.

Figure 7:
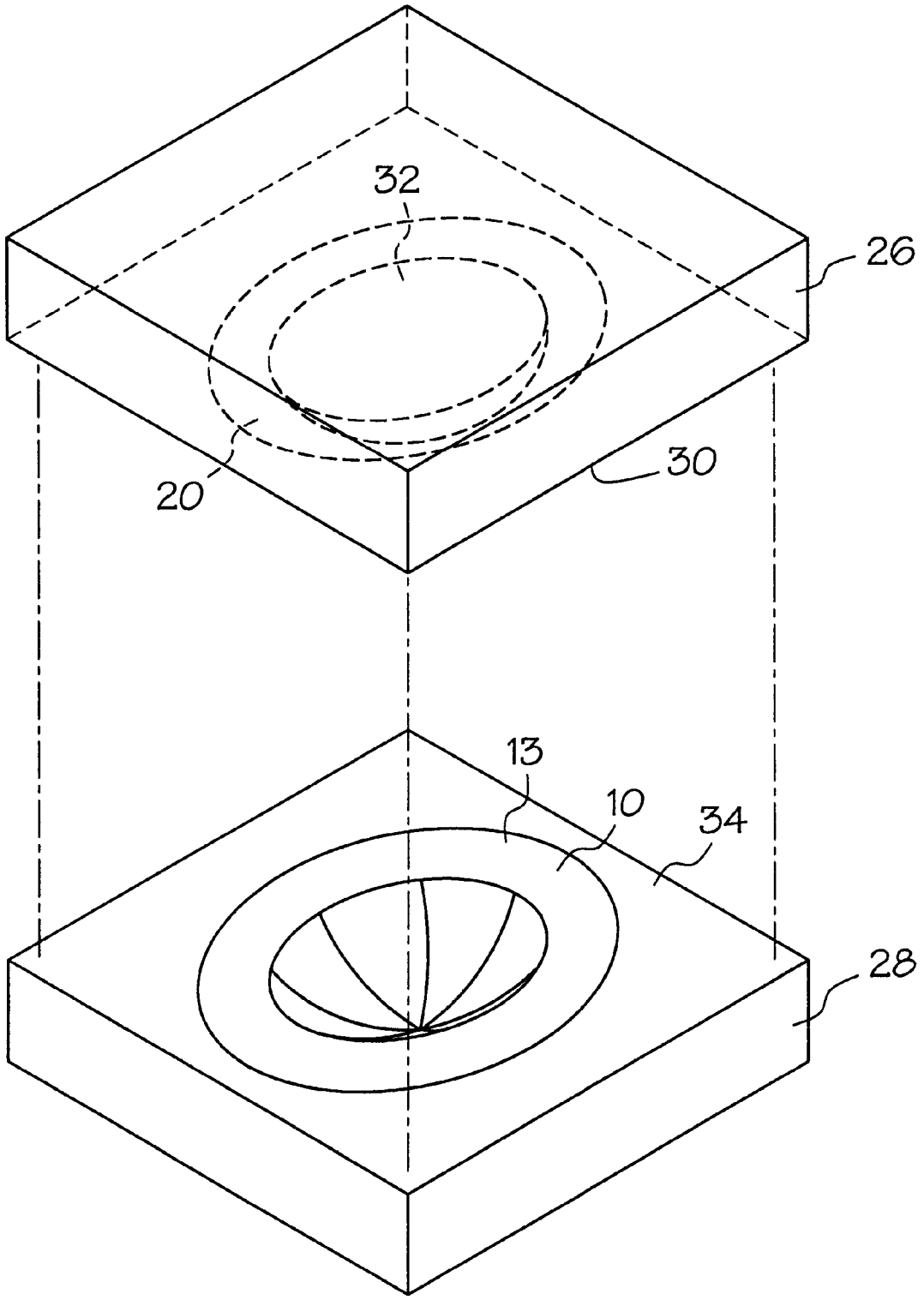
FIG. 7 illustrates another process step of the preferred embodiment of the present invention utilizing the mold component.

As shown in FIG. 7, the next step is to remove the 'dummy' member 38 from the female mold component 28 and replace it with the actual outer covering member 10 used in the construction of the helmet. Note that the outer covering member is oriented such that the bowl-shaped head portion 12 is received within the hemispherical recess 36 of the female mold component 28, such that the brim portion 14 of the covering member is received on the flat active surface 34 of the female mold component and such that the rough inner surface 13 of the covering member faces outwardly towards the male mold component 26. Also note that after the 'dummy' member 38 has been removed, it is not discarded because it can be used over and over again in the partial curing step as described above. It is to be understood that it is also within the scope of the present invention to coat or line the active surfaces of the female mold component with a permanent or removable thermoplastic resin repellant material as an alternative to utilizing the 'dummy' member.

Figure 8:
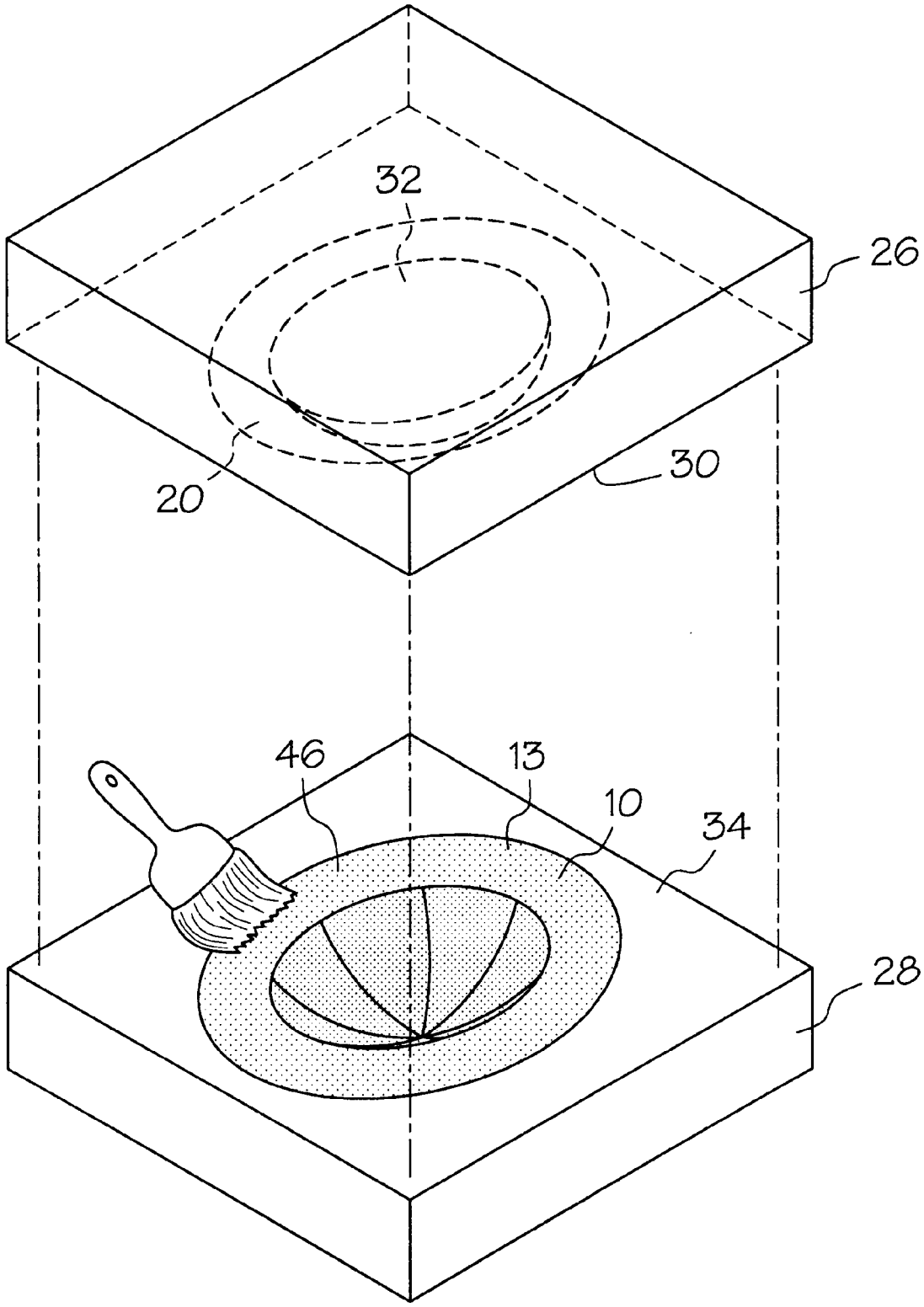
FIG. 8 illustrates another process step of the preferred embodiment of the present invention utilizing the mold component.

As shown in FIG. 8, a thin 'hot coat' layer of thermoset resin, catalyst and filler is brushed, or otherwise applied onto the rough inner surface 13 of the outer covering member 10. The filler material preferably includes chalk and/or talc; and preferably, 4 g of the filler is used for every 100 g of thermoset resin. Once this thin 'hot coat' layer has been applied to the rough inner surface of the outer covering member 10, the mold is activated again (see FIG. 5 again) such that the female and male mold components are pressed together for sufficient period of time, applying a sufficient temperature and pressure to finally-cure the respective components of the firefighter helmet together. The final curing time is at least approximately 3 minutes, the final curing temperature applied ranges from approximately 100° F. to approximately 200° F. and the final curing pressure applied ranges from approximately 300 psi to approximately 500 psi.

It has been found that by partially curing the composite layer of thermoset resin and reinforcing fibers to the inner liner before finally-curing the cover member and inner liner together, the thermoset resin will be much less likely to flow through the stitched seams in the outer covering member during the final curing step. This substantially eliminates the need to 'clean' hardened resin from the outer, finished surfaces of the firefighting helmet when the curing processes are complete. Alternative steps suitable for controlling the flow of resin through the stitched seams includes: sealing the seams of the covering member with a sealant, such as a silicone sealant; applying tape to the inner surface of the outer covering member along the seams; curing a thin 'pre-resin' coating to the inner surface of the outer covering member. All of such alternative steps are within the scope of certain aspects of the present invention.

Once the finally cured helmet is removed again from the mold device, the helmet is then preferably placed in a chamber for approximately 2–12 hours where the temperature in the chamber ranges from approximately 100° F. to approximately 300° F to post-cure the helmet. Once this post-curing step is completed, the helmet can be trimmed and the final helmet components, such as webbing, face mask, etc. can be assembled thereto.

Following from the above description, it should be apparent to those of ordinary skill in the art that, while the designs and processes herein described constitute preferred embodiments of the present invention, it is to be understood that the invention is not limited to these precise designs and processes, and that changes may be made therein without departing from the scope of the invention.

What is claimed is:

1. A method for fabricating a firefighting helmet, comprising the steps of:

providing an outer leather covering, the covering including a bowl shaped head portion attached to a brim portion;

providing an inner liner, the liner including at least a bowl shaped head portion;

positioning a layer of reinforcing fibers between an inner surface of the covering and an outer surface of the liner;

positioning thermoset resin between the inner surface of the covering and the outer surface of the liner;

assembling the covering with the liner such that the bowl shaped head portion of the liner is received within the bowl shaped head portion of the covering; and curing the covering, liner, reinforcing fibers and resin together.

2. The method of claim 1, wherein the curing step includes the step of pressing the covering and the liner together, applying an appropriate temperature and pressure, for a sufficient period of time such that the resin flows around the reinforcing fibers and bonds the covering, the liner and the reinforcing fibers together.

3. The method of claim 2, wherein:

the appropriate temperature applied ranges from approximately 100° to approximately 200° F.;

the appropriate pressure applied ranges from approximately 300 psi to approximately 500 psi; and the sufficient period of time ranges from approximately 10 to approximately 25 minutes.

4. The method of claim 3, wherein the appropriate temperature applied is approximately 120° F. and the sufficient period of time is approximately 20 minutes.

5. The method of claim 1, wherein the thermoset resin is selected from a group consisting of polyesters, vinyl esters and epoxies and wherein the thermoset resin includes a curing agent.

6. The method of claim 5, wherein the thermoset resin is an epoxy based vinyl ester and includes a methyl ethyl ketone curing agent.

7. The method of claim 5, wherein a substantial portion of the reinforcing fibers are selected from a group consisting of glass fibers, aramid fibers, azol fibers and any combination of glass, aramid and azol fibers.

8. The method of claim 5, wherein:

the curing step includes the step of pressing the covering and the liner together, applying an appropriate temperature and pressure, for a sufficient period of time such that the resin flows around the reinforcing fibers and bonds the covering, the liner and the reinforcing fibers together;

the appropriate temperature applied ranges from approximately 100° to approximately 200° F.;

the appropriate pressure applied ranges from approximately 300 psi to approximately 500 psi; and the sufficient period of time ranges from approximately 10 to approximately 25 minutes.

9. The method of claim 1, wherein the covering and the liner are fabricated from a chrome tan leather.

10. The method of claim 1, wherein the curing step includes the step of placing the covering and the liner in a correspondingly shaped mold.

11. A method for fabricating a firefighting helmet, comprising the steps of:

providing a male mold component, the male mold component having a flat inner surface and a substantially hemispherical lobe extending therefrom;

providing a female mold component, the female mold component having a flat inner surface and a substantially hemispherical recess extending into the flat inner surface, the recess having a recess surface;

orienting the male and female mold components so that the hemispherical lobe of the male mold component is received within the hemispherical recess of the female mold component when they are pressed towards one another;

providing an outer leather covering, the covering including a bowl shaped head portion attached to a brim portion;

positioning the outer covering on the female mold component, the bowl shaped head portion being received within the hemispherical recess of the female mold component and the brim portion being received on the flat surface of the female mold component;

providing an inner liner, the liner including a bowl shaped head portion attached to a brim portion;

positioning the inner liner on the male mold component, the bowl shaped head portion being received on the hemispherical lobe of the male mold component and the brim portion being received on the flat surface of the male mold component;

positioning a layer of reinforcing fibers between the covering and the inner liner;

positioning thermoset resin between the covering and the inner liner; and finally-curing the inner liner, the reinforcing fibers, the thermoset resin and the outer covering together by pressing the male and female mold components together for a final-curing time.

12. The method of claim 11, wherein the step of positioning thermoset resin between the covering and the inner liner includes the steps of:

providing a layer of thermoset resin repellant material on the flat inner surface and recess surface of the female mold component;

positioning the inner liner on the male mold component, the bowl shaped head portion being received on the hemispherical lobe of the male mold component and the brim portion being received on the flat surface of the male mold component;

positioning the layer of reinforcing fibers and the thermoset resin between the inner liner and the layer of thermoset resin repellant material; and partially curing the thermoset resin and reinforcing fibers to the inner liner by pressing the male and female mold components together for a partial-curing time.

13. The method of claim 12, wherein the step of providing a layer of thermoset resin repellant material on the flat inner surface and recess of the female mold component includes the steps of:

providing a dummy covering of flexible material, the dummy covering including a bowl shaped head portion and a brim portion extending therefrom;

attaching a layer of thermoset resin repellant material to an inner surface of the dummy covering; and positioning the dummy covering on the female mold component, the bowl shaped head portion being received within the hemispherical recess of the female mold component and the brim portion being received on the flat surface of the male mold component.

14. The method of claim 13, wherein the layer of thermoset resin repellant material is a sheet of natural rubber material.

15. The method of claim 13, wherein the partial-curing time is approximately six to nine minutes and the final-curing time is at least approximately three minutes.

16. The method of claim 15, wherein the partial-curing and final-curing steps are performed applying a temperature ranging from approximately 100° to approximately 200° F. and applying a pressure ranging from approximately 300 psi to approximately 500 psi.

17. The method of claim 13, further comprising the step of, after the final-curing step, post-curing the helmet by placing the finally cured helmet in a post-curing temperature for a post-curing time.

18. The method of claim 17, wherein the post-curing temperature ranges from approximately 100° to approximately 200° F. and the post-curing time ranges from approximately 2 hours to approximately 12 hours.

19. The method of claim 13, further comprising the step of, prior to the final-curing step, applying a thin layer of thermoset resin to the outer covering member.

20. The method of claim 19, wherein the thin layer of thermoset resin includes a filler material.

21. The method of claim 20, wherein the filler material is selected from a group consisting of talc, chalk and a combination of talc and chalk.

22. The method of claim 12, wherein the thermoset resin is an epoxy based vinyl ester.

23. The method of claim 11, wherein the final-curing time ranges from approximately 10 minutes to approximately 25 minutes and the final-curing step is performed applying temperature ranging from approximately 100° F. to approximately 200° F. and applying a pressure ranging from approximately 300 psi to approximately 500 psi.

24. The method of claim 11, wherein the outer covering includes a rough surface and a finished surface and the step of positioning the outer covering on the female mold component includes the step of orienting the outer covering so that the rough surface faces the male mold component.

25. The method of claim 24, wherein the inner liner is leather and includes a rough surface and a finished surface and the step of positioning the inner liner on the male mold component includes the step of orienting the inner liner so that the rough surface faces the female mold component.

26. The method of claim 25, wherein the outer cover and the inner liner are chrometanned leather.

27. A method for fabricating a firefighting helmet, comprising the steps of:

providing an inner liner, the liner including at least a bowl shaped head portion;

partially curing a composite layer of thermoset resin and reinforcing fibers to an outer surface of the inner liner;

providing an outer leather covering, the covering including at least a bowl shaped head portion;

assembling the covering with the liner such that the bowl shaped head portion of the liner is received within the bowl shaped head portion of the covering; and finally-curing the covering, liner, reinforcing fibers and resin together.

28. The method of claim 27, further comprising the step of, prior to the finally-curing step, applying a relatively thin layer of thermoset resin to an inner surface of the covering.

29. The method of claim 28, wherein the thin layer of thermoset resin includes a filler material.

30. The method of claim 29, wherein the thermoset resin is an epoxy based vinyl ester.

31. A method for fabricating a protective helmet, comprising the steps of:

providing an outer leather covering, the covering including at least a bowl shaped head portion;

providing an inner liner, the liner including at least a bowl shaped head portion;

positioning a layer of reinforcing fibers between an inner surface of the covering and an outer surface of the liner;

positioning thermoset resin between the inner surface of the covering and the outer surface of the liner, the thermoset resin including a curing agent;

assembling the covering with the liner such that the bowl shaped head portion of the liner is received within the bowl shaped head portion of the covering; and curing the covering, liner, reinforcing fibers and resin together.

32. A composite firefighting helmet comprising a leather outer covering having a bowl shaped head portion and a brim portion and an inner liner having a bowl shaped head portion and a brim portion cured together with reinforcing fibers and epoxy based vinyl ester resin positioned therebetween.

33. The composite firefighting helmet of claim 32, wherein the inner liner is leather.

34. The composite firefighting helmet of claim 33, wherein the outer covering and inner liner are chrome tanned leather.

35. The composite firefighting helmet of claim 34, wherein the outer covering and inner liner include a finished surface and a rough surface and wherein the rough surface of the outer covering faces the rough surface of the inner liner.

* * * * *